US008405566B2

(12) United States Patent
Chow et al.

(10) Patent No.: US 8,405,566 B2
(45) Date of Patent: Mar. 26, 2013

(54) BROAD BAND DIPOLE ANTENNA

(75) Inventors: John Chow, Saratoga, CA (US); Chang-Ching Lin, Tu-Cheng (TW); Chun-Chieh Tseng, Tu-Cheng (TW); Sheng-Che Chang, Tu-Cheng (TW); Jui-Kuang Chung, Tu-Cheng (TW); Taiichi Yamaguchi, Yokohama (JP)

(73) Assignee: Hon Hai Precision Ind. Co., Ltd., New Taipei (TW)

( * ) Notice: Subject to any disclaimer, the term of this patent is extended or adjusted under 35 U.S.C. 154(b) by 337 days.

(21) Appl. No.: 12/795,676

(22) Filed: Jun. 8, 2010

(65) Prior Publication Data

US 2010/0309091 A1 Dec. 9, 2010

(30) Foreign Application Priority Data

Jun. 8, 2009 (TC) ..... 98210122 U

(51) Int. Cl.
*H01Q 9/16* (2006.01)
*H01Q 1/36* (2006.01)

(52) U.S. Cl. ..... 343/793; 343/895; 343/702

(58) Field of Classification Search ..... 343/793, 343/895, 702

See application file for complete search history.

(56) References Cited

U.S. PATENT DOCUMENTS

| | | | | |
|---|---|---|---|---|
| 1,946,603 | A * | 2/1934 | Von Wedel | 428/592 |
| 4,054,500 | A * | 10/1977 | Parent | 204/487 |
| 7,102,576 | B2 | 9/2006 | Kim | |
| 2008/0165073 | A1 * | 7/2008 | Chou | 343/793 |

* cited by examiner

*Primary Examiner* — Hoang V Nguyen

(74) *Attorney, Agent, or Firm* — Wei Te Chung; Ming Chieh Chang

(57) ABSTRACT

An antenna (100) comprising a first pole portion (20), a first helical portion (30), a second pole portion (40) and a second helical portion (50), each of which connects the next in turn along a line, said second helical portion (50) having a plurality of cylindrical whorls, wherein the second helical portion is coated with metal (60) so that the whorls are connected to a neighbor one by the metal (60).

5 Claims, 4 Drawing Sheets

BROAD BAND DIPOLE ANTENNA

BACKGROUND OF THE INVENTION

1. Field of the Invention

The present invention relates to a dipole antenna.

2. Description of Related Art

U.S. Patent Publication No. 2008/0165073, published on Jul. 10, 2008, discloses an omni-directional high gain dipole antenna. The antenna includes a first rod antenna portion, a first helical antenna portion, a second rod antenna portion, a second helical antenna portion, and an impedance matching portion. The helical antenna portions having different helical pitches are serially-connected to the rod antenna portions, so as to prolong an antenna array distance of the dipole antenna. The serially-connected impedance matching portion adjusts a line impedance value of the dipole antenna, so as to enhance a radiation field pattern gain of the dipole antenna.

The present invention is to provide an antenna of this kind with high gain and stable electrical performance.

SUMMARY OF THE INVENTION

An object of the present invention is to provide an antenna. The antenna comprises a first pole portion, a first helical portion connected to said first pole portion, a second pole portion connected to the first helical portion, and a second helical portion connected to the second pole portion. The second helical portion has a plurality of cylindrical whorls. The second helical portion is coated with metal so that the whorls are connected to form a barrel.

Other objects, advantages and novel features of the invention will become more apparent from the following detailed description of a preferred embodiment when taken in conjunction with the accompanying drawings.

BRIEF DESCRIPTION OF THE DRAWINGS

For a more complete understanding of the present invention, and the advantages thereof, reference is now made to the following descriptions taken in conjunction with the accompanying drawings, in which.

DETAILED DESCRIPTION OF THE INVENTION

Figure 1:
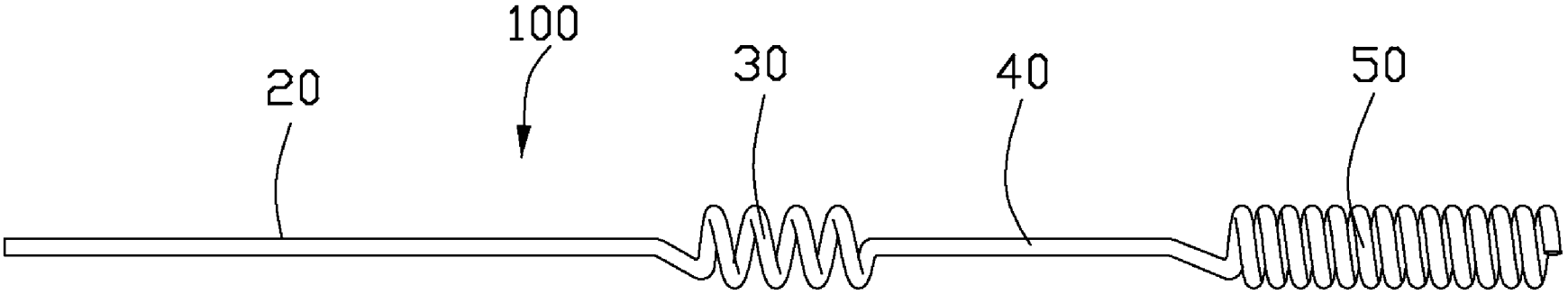
FIG. 1 is a front view of an antenna according to the present invention, except that a second helical portion of the antenna is not coated with metal.

Reference will now be made to the drawing figures to describe the present invention in detail.

Figure 2:
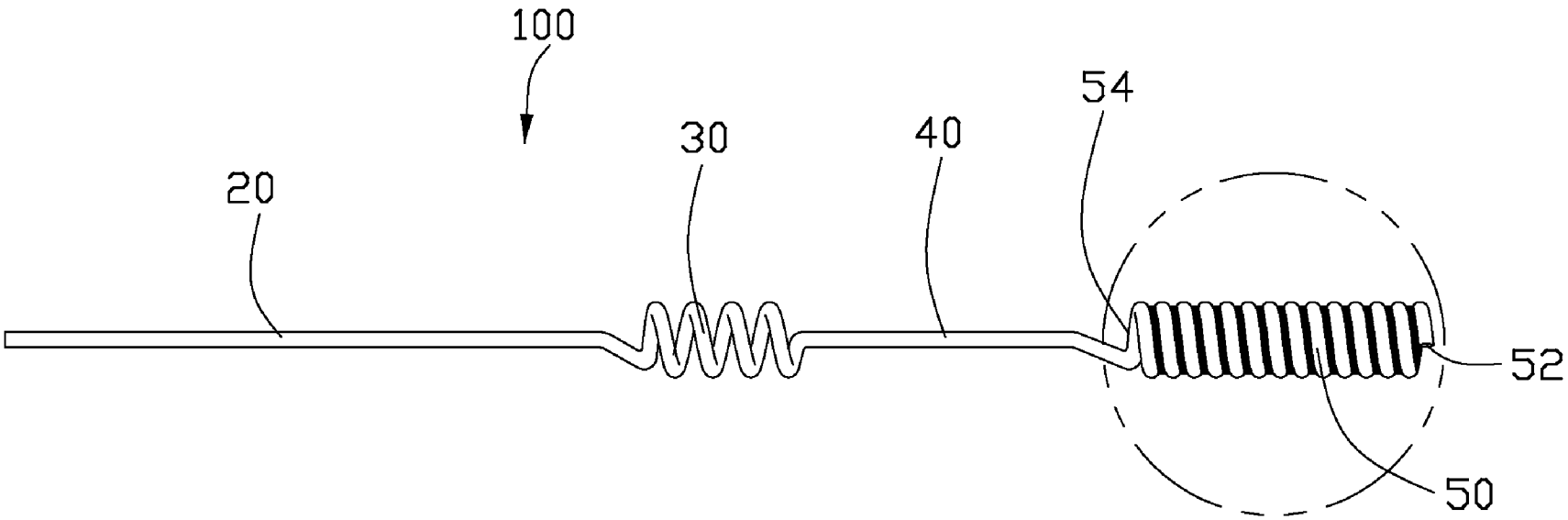
FIG. 2 is a front view of the antenna according to the present invention.
Figure 3:
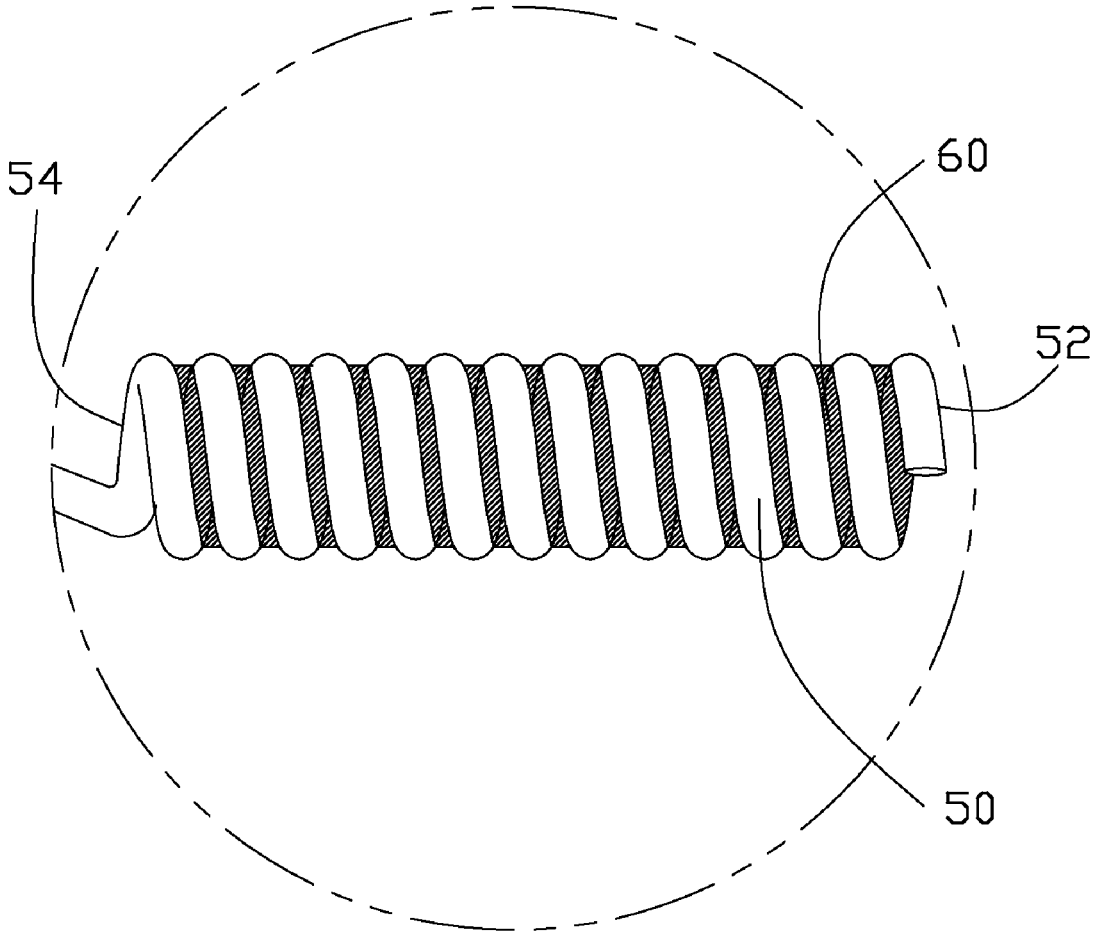
FIG. 3 is a scaled view of a circle portion shown in FIG. 2.
Figure 4:
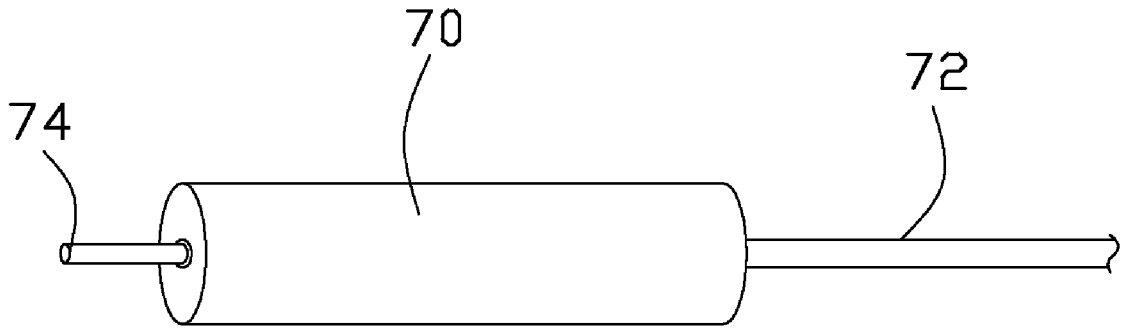
FIG. 4 is a front view of a conductor to be connected to the antenna show in FIG. 2.

Referring to FIGS. 1-3, an embodiment of the first invention is disclosed as an omni-directional dipole antenna 100 having high gain. The antenna 100 comprises a first pole portion 20, a first helical portion 30 connected to said first pole portion 20, a second pole portion 40 connected to the first helical portion 50, and a second helical portion 50 connected to the second pole portion 40. The second helical portion 50 has a plurality of cylindrical whorls. The second helical portion 50 is coated with metal 60 so that the whorls are connected to form a barrel, which enhances a radiation field pattern gain of the antenna 100 and makes the characters of the antenna 100 steadier. The method of coating metal can be dipping into molten tin furnace, soldering with tin or plating with Tin. The first pole portion 20, the first helical portion 30, the second pole portion 40 and the second helical portion 50 are connected along a straight line. The second helical portion 50 has a first end 52 connected to a feed signal and an opposite second end 54 connected to the second pole portion 40. The first end 52 of the second helical portion 50 is physically connected to a conductor 70 (shown in FIG. 4). The conductor 70 has a dimension larger than the pole portions 20, 40. The conductor 70 is electrically connected to an outer conductor of a coaxial feed wire 72, and a center conductor 74 of the coaxial feed wire 72 is electrically connected to the first end 52 of the second helical portion 50 to provide the feed signal.

It is to be understood, however, that even though numerous characteristics and advantages of the present invention have been set forth in the foregoing description, together with details of the structure and function of the invention, the disclosure is illustrative only, and changes may be made in detail, especially in matters of shape, size, and arrangement of parts within the principles of the invention to the full extent indicated by the broad general meaning of the terms in which the appended claims are expressed.

What is claimed is:

1. An antenna comprising:

a first pole portion;

a first helical portion connected to said first pole portion;

a second pole portion connected to the first helical portion; and a second helical portion connected to the second pole portion, said second helical portion having a plurality of cylindrical whorls, wherein the second helical portion is coated with metal so that the whorls are connected to form a barrel, wherein the antenna is devoid of a filamentary core within the second helical portion.

2. An antenna as claimed in claim 1, wherein the first pole portion, the first helical portion, the second pole portion and the second helical portion are connected along a straight line.

3. An antenna as claimed in claim 2, wherein the second helical portion has a first end connected to a feed signal and an opposite second end connected to the second pole portion.

4. An antenna as claimed in claim 3, wherein the metal coating the second helical portion is Tin.

5. An antenna as claimed in claim 4, wherein the first end of the second helical portion is connected to a conductor and the conductor is connected to a feed wire, the conductor has a dimension larger than the pole portions.

* * * * *